US010450746B2

(12) United States Patent
Pul

(10) Patent No.: US 10,450,746 B2
(45) Date of Patent: Oct. 22, 2019

(54) FOLDED DOME LIKE RETRACTABLE OPENING STRUCTURE AND METHOD

(71) Applicant: George Pul, Las Vegas, NV (US)

(72) Inventor: George Pul, Las Vegas, NV (US)

( * ) Notice: Subject to any disclaimer, the term of this patent is extended or adjusted under 35 U.S.C. 154(b) by 88 days.

(21) Appl. No.: 15/262,009

(22) Filed: Sep. 12, 2016

(65) Prior Publication Data

US 2017/0089093 A1 Mar. 30, 2017

Related U.S. Application Data

(60) Provisional application No. 62/234,661, filed on Sep. 30, 2015.

(51) Int. Cl.
*E04B 7/16* (2006.01)

(52) U.S. Cl.
CPC ..... *E04B 7/166* (2013.01)

(58) Field of Classification Search
CPC . E04B 7/16; E04B 7/163; E04B 7/166; E04H 3/14
USPC ..... 52/6, 66, 72; 135/28, 29, 31, 98, 99
See application file for complete search history.

(56) References Cited

U.S. PATENT DOCUMENTS 2,466,595 A * 4/1949 Korman ..... A45B 25/18 135/15.1
3,205,904 A * 9/1965 Kreachbaum ..... A45B 19/00 135/15.1
4,023,582 A * 5/1977 Buzzella ..... A45B 11/00 135/15.1
4,566,475 A * 1/1986 Wund ..... E04B 1/3448 135/114
4,751,800 A * 6/1988 Kida ..... E04B 1/3211 52/66
2007/0266648 A1* 11/2007 Hoberman ..... E04B 7/166 52/80.1

* cited by examiner

*Primary Examiner* — William V Gilbert

(57) ABSTRACT

A Folded Dome like Retractable Opening Structure and Method of the present invention is an hourglass in external appearance with a narrow waist and a mirrored double truncated flexible cone-like structure, with one primary truncated flexible cone-like structure on bottom intermediately supported and connected by one secondary truncated flexible cone-like structure on top. The retractable opening of the present invention is the truncated open end of the primary truncated flexible cone-like structure, where it is flexible to expand to open toward and contract to close away from its peripheral. In operation, the double truncated flexible cone-like structure is a slider crank mechanism, where, power is applied to the secondary truncated flexible cone-like structure, the slider, which moves vertically; the primary truncated flexible cone-like structure, the crank, is rotated; and rotation of the primary truncated flexible cone-like structure forces its truncated open end, same as the retractable opening of the present invention, to uniformly move inward to close and outward to open. A Folded Dome like Retractable Opening Structure is especially suitable for expansive retractable roofs on domed structures often found on a sports stadium.

2 Claims, 6 Drawing Sheets

FOLDED DOME LIKE RETRACTABLE OPENING STRUCTURE AND METHOD

FIELD

The present invention relates generally to retractable or deployable openings for multiple applications, and more particularly for use on huge retractable roofs often found on a large domed sports stadium.

BACKGROUND OF THE INVENTION

Retractable roofs on large domed sports stadiums and other large facilities are modern engineering marvels. A Folded Dome like Retractable Opening Structure and Method of the present invention emulate a simple umbrella to provide shelter from rain and sun, and the umbrella is retractable, yet light weight, strong, and compact. An umbrella in its simplicity has its canopy cantilever supported by ribs from its central pole, and the canopy is folded and unfurled from the central pole. The present invention, like an umbrella, opens and closes a retractable opening by folding and unfolding, or stretching and compressing a truncated flexible cone-like structure made of corrugated shell. But unlike an umbrella, the retractable opening of the present invention is an open truncated end of a truncated flexible cone-like structure, supported peripherally, expanded outward to open toward and contracted inward to close away from the retractable opening periphery, and leaving an unobstructed view area interior to the periphery.

A Folded Dome like Retractable Opening Structure of the present invention, enormous in size that may span an area equivalent to 700 feet in diameter, is particularly suitable for an expansive doomed retractable roof often found on a large domed sports stadium.

SUMMARY OF THE INVENTION

A Folded Dome like Retractable Opening Structure and Method of the present invention is generally directed to a retractable opening on an expansive doomed roof often found on a sports stadium. It comprises a double truncated flexible cone-like structure, comprising one primary intermediately supported and connected by one secondary, with the primary at bottom and secondary on top, and a narrow waist where they are connected. A secondary truncated flexible cone-like structure, except having a greater amount or degree of truncation, is identical to and a mirror image, externally, of a primary truncated flexible cone-like structure about a narrow waist line where the primary is connected to and fitted within the secondary truncated flexible cone-like structures. A truncated flexible cone-like structure is made of flexible corrugated shell, and has two open ends—a pinned support base end to remain stationary relative to its support, and a free flexible truncated end to move and changing in size. Both open ends, having same circular, rectangular, or other shapes, defines a truncated flexible cone-like structure as a truncated cone, sphere, pyramid, or other shell shaped objects. For the primary truncated flexible cone-like structure, its free flexible truncated end is the retractable opening of the present invention.

The present invention further comprises a support base frame matched in size and shape to its connected pinned support base end of a truncated flexible cone-like structure; supports for the base frames, which is grounded to be stationary for the primary truncated flexible cone-like structure, but is constrained for vertical motion for the secondary truncated flexible cone-like structure; and other provisions, including air and water tight seals, means to relieve stress and strains from flexible corrugated shell, and other considerations such as power and control systems.

A double truncated flexible cone-like structure is a slider crank mechanism, where, the primary truncated flexible cone-like structure, the crank, is rotated, and the secondary truncated flexible cone-like structure, the slider, is moved vertically. In operational sequences: Power is applied to the support base frame of the secondary truncated flexible cone-like structure, the slider, to move them vertically. The waist of the double truncated flexible cone-like structure moves vertically as well as expands and contracts in size. The primary truncated flexible cone-like structure, the crank, is rotated. Rotation of the primary truncated flexible cone-like structure forces its free flexible truncated end, same as the retractable opening of the present invention, to uniformly expand outward to open toward and contract inward to close away from the retractable opening periphery.

A Folded Dome like Retractable Opening Structure and Method of the present invention has the external appearance of an hourglass with a narrow waist and a mirrored double truncated cone-like structure. Visible on bottom is a portion of the primary truncated cone-like structure with its free flexible truncated end hidden, and visible on top is the entirety of the secondary truncated cone-like structure, including its free flexible truncated end. Internally, only visible is the entirety of the primary truncated flexible cone-like structure, including its free flexible truncated end, fully opened, fully closed, or in between.

What is novel of a Folded Dome like Retractable Opening Structure and Method of the present invention are: The use of the free flexible truncated end of a truncated flexible cone-like structure as the retractable opening; and the use of a slider crank mechanism from a double truncated flexible cone-like structures, one primary, the crank, intermediately supported and connected by one secondary, the slider, for opening and closing of the retractable opening. All other assemblies and systems are essential but not novel to the present invention, and they are described in more detail as appropriate for the preferred embodiment of a Folded Dome like Retractable Opening Structure and Method of the present invention.

DESCRIPTION OF THE PREFERRED EMBODIMENT

Figure 1:
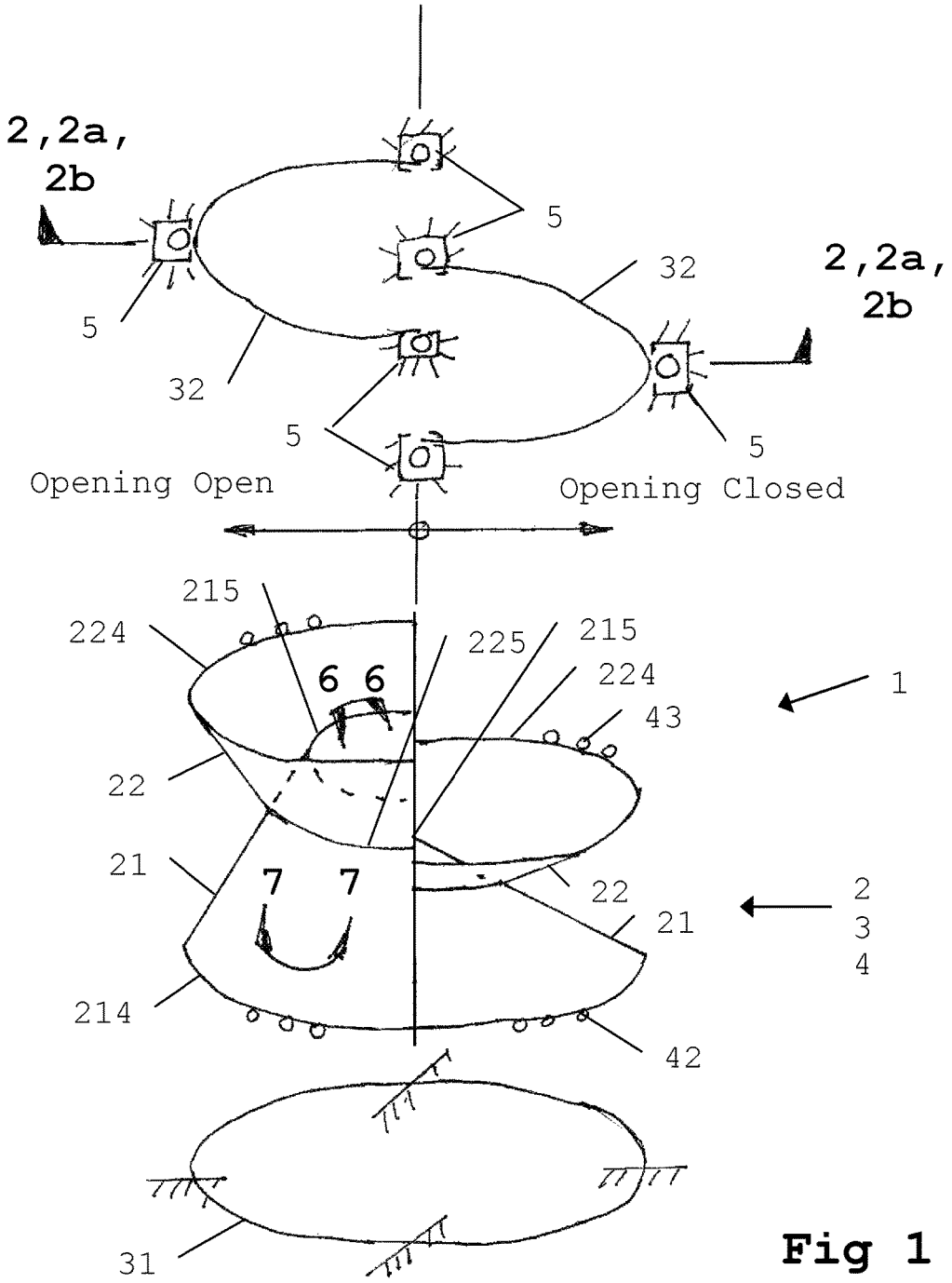
FIG. 1 is a perspective and composite view of the preferred embodiment of Folded Dome like Retractable Opening Structure of the present invention, with retractable opening shown both fully opened and closed, and support base frames shown separated from the double truncated flexible cones.

A preferred embodiment of Folded Dome like Retractable Opening Structure and Method of the present invention comprises a double truncated flexible cone with a narrow waist, where one primary truncated flexible cone at bottom is intermediately supported and connected at the narrow waist by one secondary truncated flexible cone on top. A secondary truncated flexible cone, except having a greater amount or degree of truncation, is identical to and a mirror image, externally, of a primary truncated flexible cone about a narrow waist line where the primary is connected to and fitted within the secondary truncated flexible cone. A truncated flexible cone of the preferred embodiment, made of a flexible corrugated shell, has a pinned support base end to remain stationary relative to its support, and a free flexible truncated end, been made of a flexible corrugated shell, is flexible for radial expansion to open and contraction to close its peripheral. Both truncated flexible cones are external mirror images, except the secondary truncated flexible cone has a greater amount or degree of truncation, and its pinned support base end is free to move vertically. At their jointed narrow waist, the primary is fitted within the secondary truncated flexible cone. For the primary truncated flexible cone, its free flexible truncated end is the retractable opening of the preferred embodiment. To maximize the retractable opening, a truncated flexible cone of the preferred embodiment has an apex angle closer or equal to 0.0 degrees corresponding to a circular cylinder.

The preferred embodiment further comprises: a support base frame matched in size and shape to its pin connected pinned support base end; supports for the base frames, which is grounded to be stationary for the primary truncated flexible cone, but is constrained for vertical motion for the secondary truncated flexible cone; and other provisions, including air and water tight seals, means to relieve stress and strain of the flexible corrugated shell, and power and control systems.

A double truncated flexible cone is a slider crank mechanism, where, the primary truncated flexible cone, the crank, is rotated, and the secondary truncated flexible cone, the slider, is moved vertically. The primary truncated flexible cone, the crank, is pinned to and rotates about its grounded stationary support base frame to force its free flexible truncated end, same as the retractable opening, to uniformly expand outward to open toward and contract inward to close away from the retractable opening periphery. The secondary truncated flexible cone, the slider, is pinned to and rotates about its support base frame, which is constrained for vertical controlled motions. In operational sequences: Power is applied to the support base frame of the secondary truncated flexible cone, the slider, to move them vertically. The waist of the double truncated flexible cone moves vertically as well as expands and contracts in size. The primary truncated flexible cone, the crank, is rotated. Rotation of the primary truncated flexible cone forces its free flexible truncated end, same as the retractable opening of the preferred embodiment, to uniformly expand outward to open toward and contract inward to close away from the retractable opening periphery.

A preferred embodiment of Folded Dome like Retractable Opening Structure and Method of the present invention has the external appearance of an hourglass with a narrow waist and a mirrored double truncated cone, where visible on bottom is a portion of the primary truncated cone with its free flexible truncated end hidden, and visible on top is the entirety of the secondary truncated cone, including its free flexible truncated end. Internally, only visible is the entirety of the primary truncated flexible cone, including its free flexible truncated end in fully opened, fully closed, or in between positions.

The retractable opening of the preferred embodiment, supported peripherally, is expanded to open toward and contracted to close away from the retractable opening periphery. Preferred embodiment 1 of Folded Dome like Retractable Opening Structure and Method of the present invention will now be described with reference to the drawings.

Unless otherwise apparent, or stated, directional references, such as "inner," "inward," "outer," "outward," "downward," "upper", "lower" etc., are for non-limiting descriptive purposes and intended to be relative to the orientation of a particular embodiment of the invention as shown in the view of that embodiment.

Figure 2:
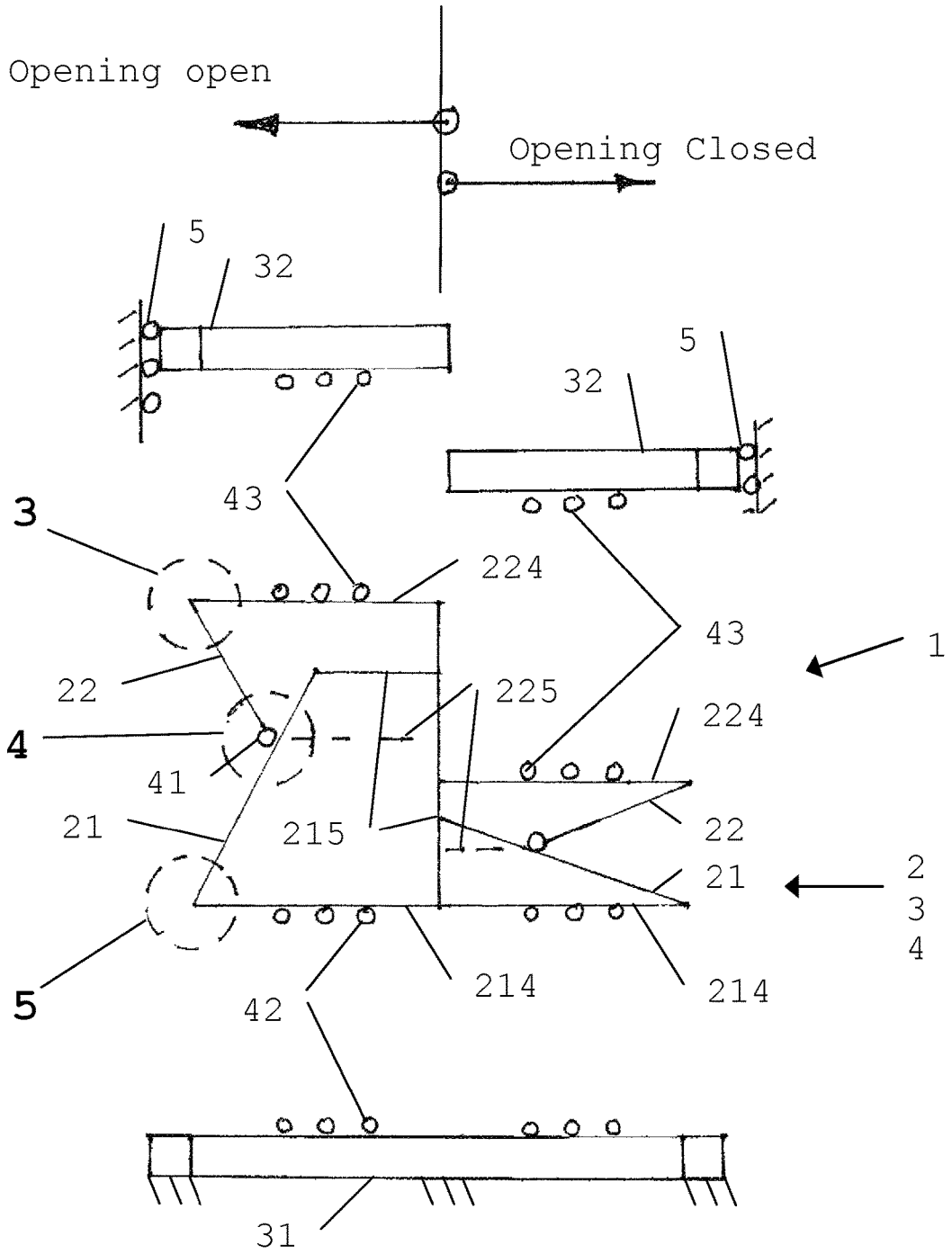
FIG. 2 is a cross section and composite view of the preferred embodiment taken along line 22 shown in FIG. 1.
Figure 2A:
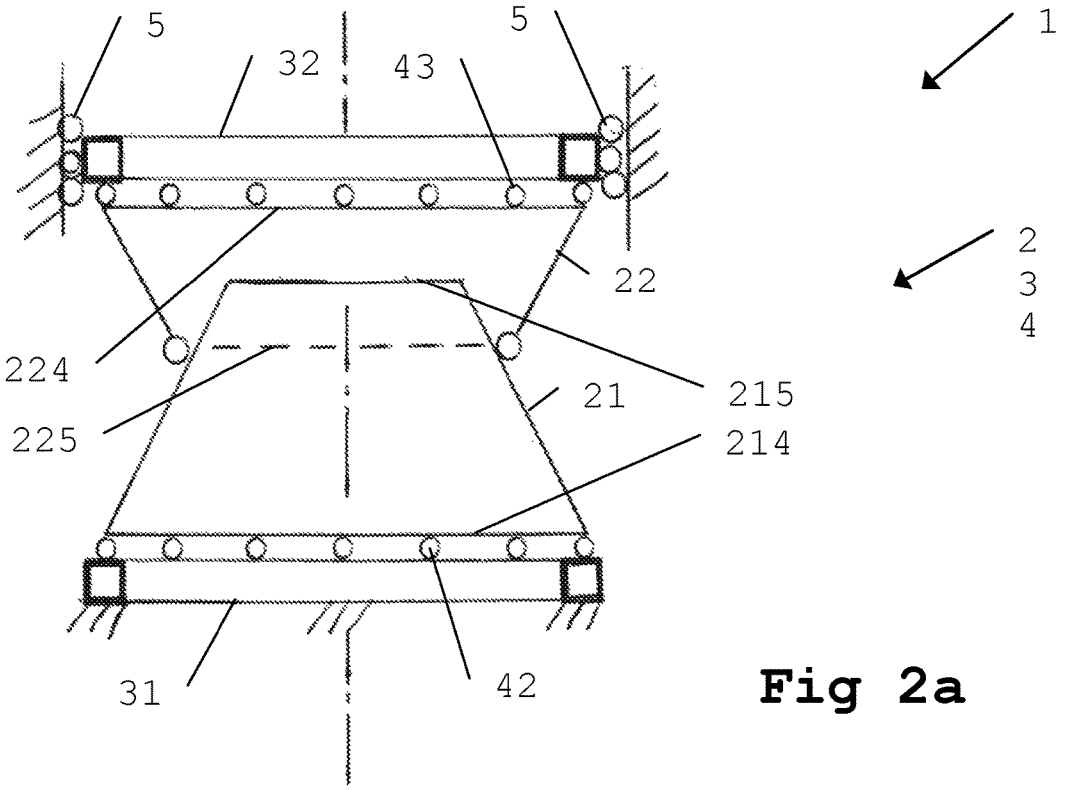
FIGS. 2*a* and 2*b* are cross section views of the preferred embodiment taken along line 22 shown in FIG. 1 with retractable opening shown fully opened and closed, respectively, and support base frames attached to their double truncated flexible cones.
Figure 2B:
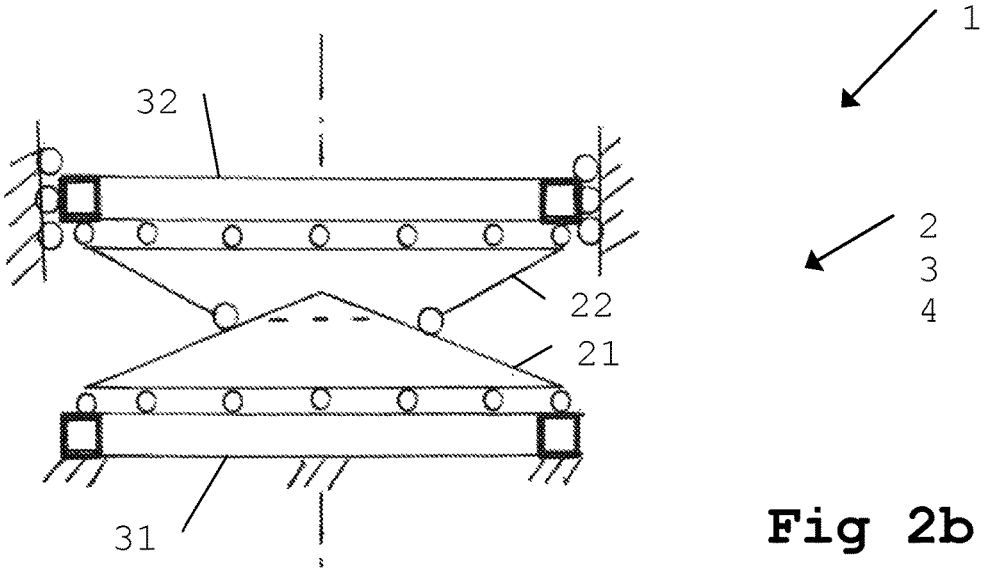
Figure 3:
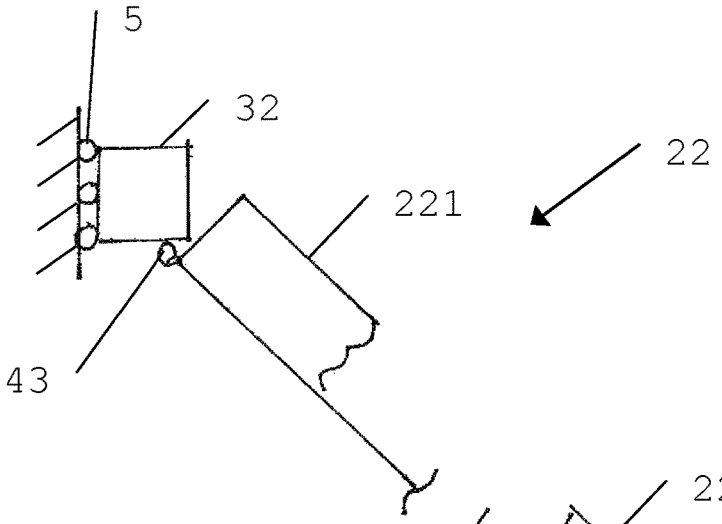
FIG. 3 is an enlarged view of the preferred embodiment taken at location 3 shown in FIG. 2.
Figure 4:
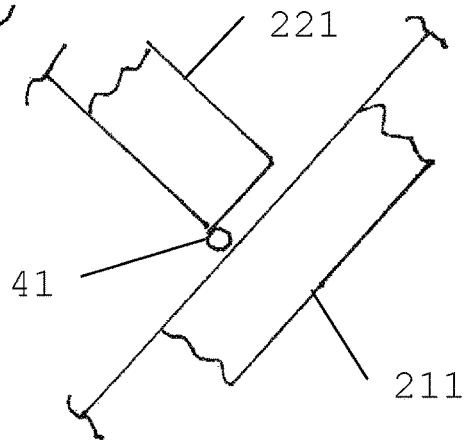
FIG. 4 is an enlarged view of the preferred embodiment taken at location 4 shown in FIG. 2.
Figure 5:
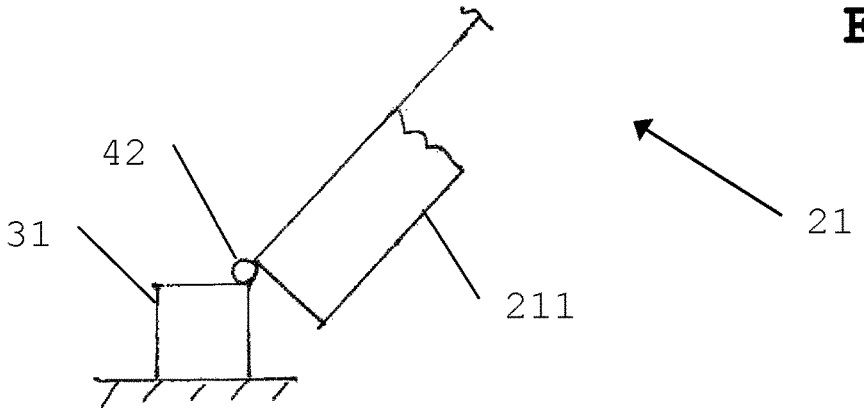
FIG. 5 is an enlarged view of the preferred embodiment taken at location 5 shown in FIG. 2.

Referring to FIGS. 1 through 5, preferred embodiment 1 of Folded Dome like Retractable Opening Structure of the present invention is shown fully opened and closed, and support base frames 3 shown exploded from double truncated flexible cone 2, in a perspective view in FIG. 1 and in an elevation cross section view in FIG. 2, and with detailed connections shown in particular by FIGS. 3, 4, and 5. Additionally for clarity, preferred embodiment 1 of Folded Dome like Retractable Opening Structure of the present invention is shown fully opened and closed in elevation cross section views in FIGS. 2*a* and 2*b*, respectively, and support base frames 3 attached to double truncated flexible cone 2. Preferred embodiment 1 comprises a double truncated flexible cone 2 which is consisted of one primary truncated flexible cone 21 intermediately supported and connected by one secondary truncated flexible cone 22. The secondary truncated flexible cone 22, except having a greater amount or degree of truncation, is identical to and a mirror image, externally, of a primary truncated flexible cone 21 about a narrow waist line where the primary truncated flexible cone 21 is connected to and fitted within the secondary truncated flexible cone 22. A primary and secondary truncated flexible cone 21 and 22 is made of corrugated shell 211 and 221, having pinned support base end 214 and 224, and free flexible truncated end 215 and 225, respectively. The free flexible truncated end 215 of primary truncated flexible cone 21 is the retractable opening of preferred embodiment 1 of the present invention. Corrugated shell 211 and 221 of primary and secondary truncated flexible cone 21 and 22, respectively, are shown in particular by FIGS. 3, 4, and 5 as both lines and parts with depths to give more clarity to the relative location of lines drawn for parts and their connecting joints in FIGS. 1, 2, 2*a* and 2*b*.

Preferred embodiment 1 further comprises support base frame 3, rotational hinges 4, and guided sliding joints 5.

Support base frame 3 is consisted of support base frames 31 and 32 to support primary and secondary truncated flexible cone 21 and 22, respectively. Rotational hinges 4 is consisted of rotational hinges 41, 42, and 43, where rotational hinges 41 joins primary to secondary truncated flexible cones 21 and 22, respectively; rotational hinges 42 joins primary truncated flexible cones 21 to support base frame 31; and rotational hinges 43 joins secondary truncated flexible cones 22 to support base frame 32. Guided sliding joints 5 supports and constrains support base frame 32 to move vertically. And no guided sliding joints 5 for support base frame 31, which is directly grounded.

Figure 6:
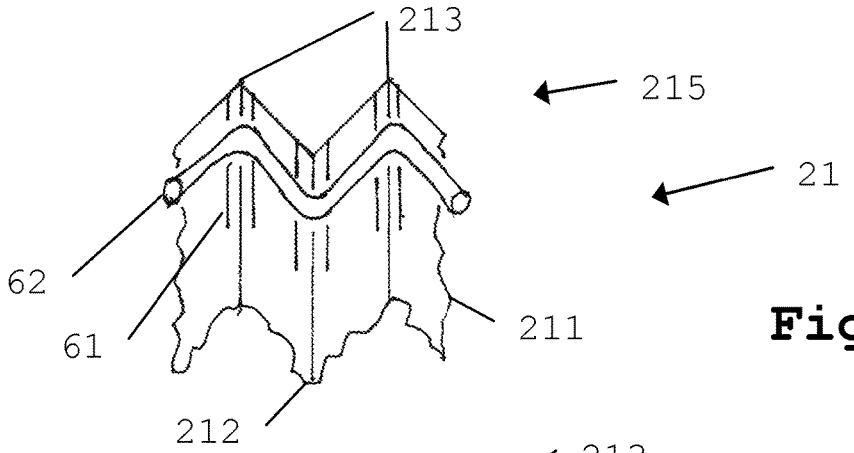
FIG. 6 is a partial perspective and enlarged detail view of the primary truncated flexible cone along its fully opened free flexible truncated end, taken at location 6 shown in FIG. 1.
Figure 7:
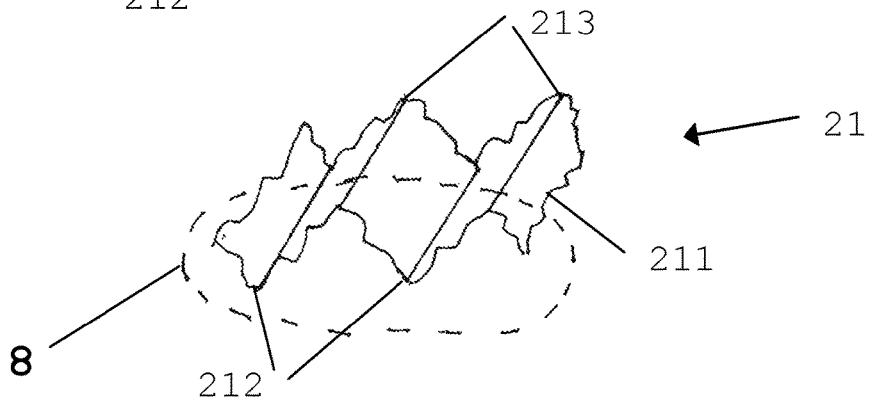
FIG. 7 is a partial perspective, cutaway, and enlarged detail view of the primary truncated flexible cone, taken at location 7 shown in FIG. 1.
Figure 8A:
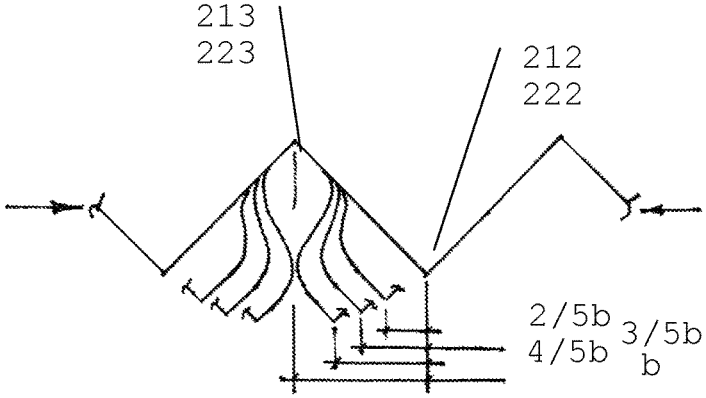
FIG. 8*a* is a partial composite schematic view of corrugates undergoing in-plane deformations taken at location 8 shown in FIG. 7.
Figure 8B:
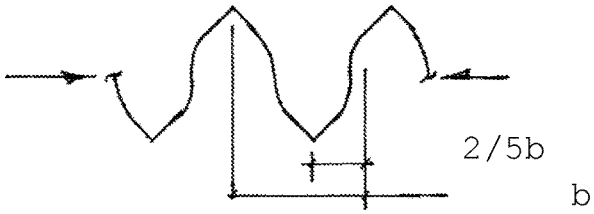
FIGS. 8*b* to *d* are partial schematic views of FIG. 8*a* undergoing incremental in-plane deformations of 2/5b, 3/5b, and 4/5b, respectively.
Figure 8C:
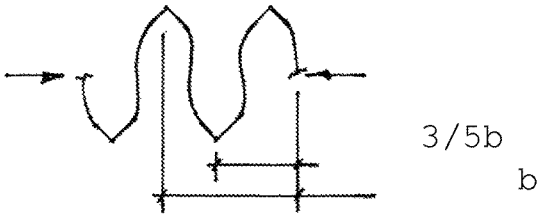
Figure 8D:
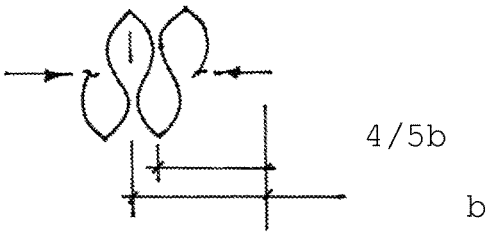

FIGS. 6 and 7 reveal construction of corrugated shell 211 of primary truncated flexible cone 21 to have reciprocal inner and outer corrugates 212 and 213, respectively. Corrugated shell 221 of secondary truncated flexible cone 22 is identically constructed to have reciprocal inner and outer corrugates 222 and 223, respectively. Corrugated shells 211 and 221 have same and equal number of reciprocal inner and outer corrugates 212, 213, 222, and 223, that are equally spaced around the circumferences of pinned support base ends and free flexible truncated ends 214, 215, 224, 225, respectively. In addition, FIG. 6 shows sealed slots 61 and water tight seal assembly 62 at free flexible truncated end 215 of corrugated shell 211 of primary truncated flexible cone 21. The free flexible truncated end 215, as it is flexed to open and close, is subjected to extreme internal stresses, but must remain elastic. Sealed slots 61 are cut into free flexible truncated end 215 to relieve the extreme internal stress. And air and water tight gasket seals assembly 62 at free flexible truncated end 215 also contribute in keeping the free flexible truncated end 215 elastic.

Corrugated shells 211 and 221 are flexible springs for in-plane axial forces and moments applied across corrugate 212, 213, 222, and 223. Subjected to increasingly higher in-plane axial force across or transverse to the corrugates causes increased corrugates 212, 213, 222, and 223 side wall deformations, as shown graphically in FIGS. 8*a*-8*d*, until the corrugates adjacent walls come into contact. Corrugates 212, 213, 222, and 223 side wall deformations are required to be elastic, and measures to keep them deform elastically are shown in FIG. 6 by a combination of sealed slots 61 to relief internal stress and strain, and by a gasket seal assembly 62 to keep positive in-between separations for corrugates 212, 213, 222, and 223 side walls.

Referring back to FIGS. 1, 2, 2*a* and 2*b*, a double truncated flexible cone 2 is a slider crank mechanism, where primary truncated flexible cone 21 is the crank, while secondary truncated flexible cone 22 is the slider. In operational sequences: Power is applied to the support base frame 32 of the secondary truncated flexible cone 22, the slider, to move them vertically. The waist of the double truncated flexible cone 2 moves vertically as well as expands and contracts in size. The primary truncated flexible cone 21, the crank, is rotated. Rotation of the primary truncated flexible cone 21 forces its free flexible truncated end 215, same as the retractable opening of the preferred embodiment, to uniformly expand outward to open toward and contract inward to close away from the retractable opening periphery.

Preferred embodiment 1 of Folded Dome like Retractable Opening Structure of the present invention described above is for the purpose of describing features and technical conceptions of both the method and structure of the invention, but it should be readily apparent that the invention is not limited to the described preferred embodiment 1 alone. A person skilled in the art may come up with various changes and modifications consistent to the technical concept disclosed herein and within the spirit and scope of the invention. A prime example is the replacement of the secondary truncated flexible cone, which is not required to be water and air tight, by a flexible structure comprising a mix of elements such as struts, cables, and even draw strings. Therefore, it is to be understood that modifications and variations may be utilized without departure from the spirit and scope of the invention disclosed herein, as those skilled in the art will readily understand. Such modifications and variations are considered to be within the purview and scope of the claimed invention and their equivalents.

I claim:

1. A folded dome like retractable opening structure comprising: a slider crank mechanism comprised of a first crank and a first slider, wherein:

a) the first crank and the first slider further comprising a respective first truncated flexible cone structure and a second truncated flexible cone structure, said cone structures each having a first open end and a second open end opposite said first open end, said respective second open ends having a width less than said respective first open ends, said second open end of said second truncated flexible cone structure being greater than said second open end of said first truncated flexible cone structure, said first truncated flexible cone structure and said second truncated flexible cone structure having a corrugated surface;

b) said second truncated flexible cone structure being inverted relative to said first truncated flexible cone structure such that said second open end of said second truncated flexible cone structure receives and surrounds said second open end of said first truncated flexible cone structure;

c) each said corrugated surfaces being flexible;

d) a first hinge connected to said second open end of said second truncated flexible cone structure and connecting said second open end of said second truncated flexible cone to said first truncated cone; a first support frame connected to and fitted around said first open end of said first truncated flexible cone structure by a second rotational hinge, and a second support frame connected to and fitted around said first open end of said second truncated flexible cone structure by a third rotational hinge; and a first end of said second support frame being connected to a surface by a sliding joint.

2. A method of operating a folded dome like retractable opening structure, comprising:

providing the folded dome like retractable opening structure of claim 1;

moving the second support frame in a vertical direction away from the first support frame resulting in expansion of the first and the second truncated flexible cone structures; and, moving the second support frame in a vertical direction toward the first support frame resulting in contraction of the first and the second truncated flexible cone structures.

* * * * *